US009915169B2

(12) United States Patent
Tibbott et al.

(10) Patent No.: US 9,915,169 B2
(45) Date of Patent: Mar. 13, 2018

(54) GAS TURBINE ENGINE END-WALL COMPONENT

(71) Applicant: ROLLS-ROYCE PLC, London (GB)

(72) Inventors: Ian Tibbott, Lichfield (GB); Dougal Richard Jackson, Derby (GB)

(73) Assignee: ROLLS-ROYCE plc, London (GB)

( * ) Notice: Subject to any disclaimer, the term of this patent is extended or adjusted under 35 U.S.C. 154(b) by 218 days.

(21) Appl. No.: 14/810,551

(22) Filed: Jul. 28, 2015

(65) Prior Publication Data

US 2016/0032764 A1 Feb. 4, 2016

(30) Foreign Application Priority Data

Jul. 30, 2014 (GB) ..... 1413456.3

(51) Int. Cl.

| | |
|---|---|
| ***F01D 25/12*** | (2006.01) |
| ***F01D 9/04*** | (2006.01) |
| *F01D 5/18* | (2006.01) |
| *F01D 9/02* | (2006.01) |

(52) U.S. Cl.

CPC ..... *F01D 25/12* (2013.01); *F01D 9/041* (2013.01); *F01D 9/047* (2013.01); *F01D 5/186* (2013.01); *F01D 5/187* (2013.01); *F01D 9/023* (2013.01); *F05D 2220/32* (2013.01); *F05D 2240/128* (2013.01); *F05D 2240/81* (2013.01); *F05D 2250/14* (2013.01); *F05D 2250/18* (2013.01);

(Continued)

(58) Field of Classification Search

CPC ..... F01D 25/12; F01D 9/041; F01D 5/186; F01D 5/187; F01D 9/047; F05D 2240/81; F05D 2260/202; F05D 2250/14; F05D 2250/18

See application file for complete search history.

(56) References Cited

U.S. PATENT DOCUMENTS 5,167,485 A * 12/1992 Starkweather ..... F01D 11/005 415/115
5,417,545 A * 5/1995 Harrogate ..... F01D 5/186 415/115

(Continued)

FOREIGN PATENT DOCUMENTS

CN 102979584 A 3/2013
EP 0 615 055 A1 9/1994

(Continued)

OTHER PUBLICATIONS

JP 2006188962 A—Translation from Espacenet.*

(Continued)

*Primary Examiner* — Justin Seabe
*Assistant Examiner* — Behnoush Haghighian
(74) *Attorney, Agent, or Firm* — Oliff PLC

(57) ABSTRACT

An end-wall component of the mainstream gas annulus of a gas turbine engine having an annular arrangement of vanes, the component including a cooling arrangement having ballistic cooling holes (33) through which, in use, dilution cooling air is jetted into the mainstream gas upstream of the vanes to reduce the mainstream gas temperature adjacent the end-wall, wherein the cooling holes are arranged in one or more circumferentially extending rows and wherein the axial position of the cooling holes in the or each row varies.

14 Claims, 8 Drawing Sheets

(52) U.S. Cl.
CPC .. *F05D 2250/184* (2013.01); *F05D 2260/202* (2013.01)

(56) References Cited

U.S. PATENT DOCUMENTS

| | | | | | |
|---|---|---|---|---|---|
| 6,154,959 | A * | 12/2000 | Goodwater | B23P 6/002 | 228/119 |
| 6,173,491 | B1 * | 1/2001 | Goodwater | B23P 6/002 | 29/889.1 |
| 6,616,405 | B2 * | 9/2003 | Torii | F01D 5/186 | 415/914 |
| 6,749,396 | B2 * | 6/2004 | Barry | F01D 5/186 | 415/115 |
| 7,204,019 | B2 * | 4/2007 | Ducotey, Jr. | B23H 9/10 | 29/402.06 |
| 7,806,650 | B2 * | 10/2010 | Heyward | F01D 9/041 | 415/115 |
| 8,205,458 | B2 * | 6/2012 | Lee | F01D 9/041 | 415/115 |
| 8,220,150 | B2 * | 7/2012 | Pellet | B23P 6/002 | 29/889 |
| 8,459,935 | B1 * | 6/2013 | Liang | F01D 5/187 | 415/115 |
| 9,512,782 | B2 * | 12/2016 | Jackson | F02C 7/18 | |
| 9,598,979 | B2 * | 3/2017 | Reed | F01D 25/12 | |
| 2007/0140849 | A1 * | 6/2007 | Flodman | F01D 5/186 | 416/97 R |
| 2008/0056907 | A1 * | 3/2008 | Heyward | F01D 9/041 | 416/96 R |
| 2010/0047056 | A1 | 2/2010 | Lee et al. | | |
| 2010/0068032 | A1 * | 3/2010 | Liang | F01D 5/186 | 415/115 |
| 2011/0097191 | A1 | 4/2011 | Bunker | | |
| 2012/0107135 | A1 * | 5/2012 | Harris, Jr. | F01D 5/186 | 416/97 R |
| 2012/0177479 | A1 * | 7/2012 | Azad | F01D 5/187 | 415/115 |
| 2016/0102562 | A1 * | 4/2016 | Evans | F01D 5/187 | 416/95 |
| 2016/0160656 | A1 * | 6/2016 | Bergman | F01D 9/041 | 60/806 |

FOREIGN PATENT DOCUMENTS

| | | | | |
|---|---|---|---|---|
| GB | 2 239 679 | A | 7/1991 | |
| JP | 2006188962 | A * | 7/2006 | F01D 5/187 |

OTHER PUBLICATIONS

Jan. 27, 2015 Search Report issued in British Patent Application No. GB1413456.3.

Dec. 3, 2015 Search Report issued in European Patent Application No. 15 17 8435.

* cited by examiner

GAS TURBINE ENGINE END-WALL COMPONENT

FIELD OF THE INVENTION

The present invention relates to an end-wall component of the working gas annulus of a gas turbine engine, the component having a cooling arrangement including ballistic cooling holes through which, in use, dilution cooling air is jetted into the working gas to reduce the working gas temperature adjacent the end-wall.

BACKGROUND OF THE INVENTION

The performance of the simple gas turbine engine cycle, whether measured in terms of efficiency or specific output, is improved by increasing the turbine gas temperature. It is therefore desirable to operate the turbine at the highest possible temperature. For any engine cycle compression ratio or bypass ratio, increasing the turbine entry gas temperature always produces more specific thrust (e.g. engine thrust per unit of air mass flow). However, as turbine entry temperatures increase, the life of an uncooled turbine falls, necessitating the development of better materials and the introduction of internal air cooling.

In modern engines, the high pressure (HP) turbine gas temperatures are now much hotter than the melting point of the blade materials used, and in some engine designs the intermediate pressure (IP) and low pressure (LP) turbines are also cooled. During its passage through the turbine, the mean temperature of the gas stream decreases as power is extracted. Therefore the need to cool the static and rotary parts of the engine structure decreases as the gas moves from the HP stage(s) through the IP and LP stages towards the exit nozzle.

Internal convection and external films are the main methods of cooling the aerofoils. HP turbine nozzle guide vanes (NGV's) consume the greatest amount of cooling air on high temperature engines. HP blades typically use about half of the NGV cooling air flow. The IP and LP stages downstream of the HP turbine use progressively less cooling air.

FIG. 1 shows an isometric view of a conventional HP stage cooled turbine. Block arrows indicate cooling air flows. The stage has NGVs 100 with inner 102 and outer 104 platforms and HP rotor blades 106 downstream of the NGVs. Upstream of the NGVs, a rear inner discharge nozzle (RIDN) 108 and a rear outer discharge nozzle (RODN) 110 are formed by respective sealing rings which bridge the gaps between end-walls (not shown) of the engine combustor and the platforms 102, 104. The RIDN and the RODN take up the relative axial and radial movement between the combustor and the NGVs.

The NGVs 100 and HP blades 106 are cooled by using high pressure air from the compressor that has by-passed the combustor and is therefore relatively cool compared to the working gas temperature. Typical cooling air temperatures are between 800 and 1000 K. Mainstream gas temperatures can be in excess of 2100 K.

The cooling air from the compressor that is used to cool the hot turbine components is not used fully to extract work from the turbine. Extracting coolant flow therefore has an adverse effect on the engine operating efficiency. It is thus important to use this cooling air as effectively as possible.

The radial gas temperature distribution supplied to the turbine from the combustor is relatively uniform from root to tip. This flat profile causes overheating problems to end-walls such as the NGV platforms 102, 104 and the blade platform 112 and shroud 114, which are difficult to cool due to the strong secondary flow fields that exist in these regions. In particular, such overheating can lead to premature spallation of thermal barrier coatings followed by oxidation of parent metal, and thermal fatigue cracking.

Any dedicated cooling flow used to cool the platforms and shroud, when reintroduced into the mainstream gas-path causes mixing losses which have a detrimental effect on the turbine stage efficiency. Thus an alternative approach is to modify the temperature profile over a radial traverse of the mainstream gas annulus by locally introducing relatively large quantities of dilution cooling air at a plane upstream of the NGV aerofoil leading edges, for example at the RIDN 108 and the RODN 110. This ballistic cooling flow penetrates the hot gas stream, due to the high angle at which the coolant is introduced, and mixes vigorously with the gas flow to locally reduce the gas temperature. The resulting peaky radial temperature profile heats up the aerofoil and cools down the end-walls, while maintaining the same average gas temperature into the NGVs.

Conventionally the ballistic flow introduced at the RIDN and RODN enters the mainstream gas-path relatively far upstream of the NGV aerofoil through circumferential rows of circular transverse cross-section holes 116, arranged in a staggered formation in the respective sealing ring. The holes are drilled with a radial orientation such that the cooling air enters the mainstream gas-path in the same radial direction.

It will be understood by the skilled person that by ballistic cooling holes (or ballistic mixing holes as they are also termed) do not generally contribute to any film cooling benefit immediately downstream of the holes but increase heat transfer rates. Ballistic cooling holes operate by reducing the temperature of the mainstream gas by mixing it with large quantities of coolant. Holes are configured in circumferentially staggered or in-line formations of axially separated rows, typically two, and have large diameters typically in the range of 1.25 mm to 2.80 mm.

The large diameter holes allow the mixing flow to penetrate into the mainstream gas as far as possible without becoming 'bent over' by the high velocity flow in the main gas path. The holes are typically drilled at steep angles to the gas washed surface, for example, in a range of between 45 and 65 degrees. Ballistic cooling holes typically operate at moderate values of blowing rate, due to the relatively low pressure ratios available to drive the flow but the higher the better.

In contrast to ballistic cooling holes there are film cooling holes which can be catagorised into conventional film cooling, and so-called effusion cooling holes schemes. The term 'Effusion' when describing film cooling holes generally applies to arrays of relative small diameter plain cylindrical holes. Typically, the hole diameter will range from between 0.25 mm and 0.35 mm depending on the method of manufacture, and are generally configured in a staggered or diamond formation with trajectories of approximately 30 to 45 degrees to the gas washed surface. Effusion cooling holes typically have relatively low values of blowing rate, for example in the range of 0.75-1.25 would be considered low.

Where the blowing rate is defined as the coolant exit to mainstream gas momentum ratio, $$\text{Blowing rate (B.R.)}=(\text{Coolant Density}\times\text{Coolant Velocity})/(\text{Gas Density}\times\text{Gas Velocity})$$

$$\text{B.R.}=(\rho\times v)_{coolant\ exit}/(\rho\times v)_{local\ gas\ stream}$$

This low momentum coolant combined with excellent coverage results in high levels of film cooling effectiveness.

Conventional film cooling holes are configured in rows and can be staggered or in-line with respect to upstream and downstream rows. Film cooling holes can be plain cylindrical shaped or have fan shaped exit regions to diffuse the flow onto the gas washed surface. Typical hole sizes range from 0.35 mm to 0.70 mm diameter. Film cooling holes are preferably drilled at shallow angles to the gas washed surface (angles of 20-30 degrees are typical. The cooling arrangement will typically operate at medium values of blowing rate, for example, $BR=1<(\rho\cdot v)c/(\rho\cdot v)g<2.5$) with the lower values being preferable.

Examples of film cooling holes can be found in US2008/0056907, CN102979584 and GB2239679.

With engine cycle gas temperatures rising and combustion temperature profiles becoming flatter, as a consequence of the drive to reduce NOx and $CO_2$ emissions, there is an increasing need to make better use of this cooling air.

SUMMARY OF THE INVENTION

The present invention is at least partly based on the realisation that appropriate shaping and distribution of the ballistic cooling holes can lead to improved penetration of the cooling air into the hot gas stream and an increase in the associated cooling benefit.

Accordingly, the present invention provides in a first aspect an end-wall component of the mainstream gas annulus of a gas turbine engine having an annular arrangement of vanes, the component including a cooling arrangement having ballistic cooling holes through which, in use, dilution cooling air is jetted into the mainstream gas upstream of the vanes to reduce the mainstream gas temperature adjacent the end-wall, wherein the cooling holes are arranged in one or more circumferentially extending rows and wherein the axial position of the cooling holes in the or each row varies.

Advantageously, axial variation in the cooling holes of the circumferentially extending rows can help reduce so-called horseshoe vortices which are created towards the base of the leading edge of the vanes. It also allows cooling air to penetrate the gas flow in a specific way such that portions of the end wall component can be more selectively cooled.

The end-wall component may have any one or, to the extent that they are compatible, any combination of the following optional features.

Preferably, the axial variation is sinusoidal. The sinusoid may be a full wave sinusoid or a half wave sinusoid having peaks extending in a downstream direction interspersed with non-sinusoidal or straight portions.

The end wall component may be a radially inner platform of a nozzle guide vane and the sinusoidal axial variation includes upstream and downstream peaks relative to the axial position of the leading edge of the vanes. The downstream peaks of an inner platform lie along the gas flow line of a stagnation region which is local to the leading edge of the vane.

The cooling holes may be arranged in two axially separated circumferentially extending rows so as to provide an upstream row and a downstream row. At least a portion of one of the rows has a portion adjacent a stagnation region of the vane. The portion adjacent the stagnation zone may be straight when viewed radially inwards along the normal plane of the principal axis of the engine.

Either or both of the upstream and downstream rows may have axial variation in relation to the leading edge of the vane.

Either or both of the upstream and downstream rows may be intermittent so as to have circumferentially extending portions of cooling holes interspersed with circumferential portions having no cooling holes. The portion with no cooling holes may be aligned with the mid-vane portion. The portion with the cooling holes may be further defined as having a circumferentially extending series of adjacent cooling holes. The centres of the adjacent cooling holes may be equally spaced. The portion with no cooling holes may extend for a circumferential length which is greater than 25% of the vane pitch. Preferably, the portion with no cooling holes extends for between 25% and 50% of the vane pitch.

The cooling holes have a diameter of 1.3 mm or greater and less than 2.8 mm. Preferably, the cooling holes have a diameter of approximately 2 mm+/−0.2 mm.

The cooling holes may have a trajectory which is inclined to the main rotational axis of the engine at an angle of between 45 and 65 degrees. Preferably, the cooling holes will have trajectory of between 50 and 55 degrees.

The cooling holes may be arranged in two axially separated rows so as to provide upstream and downstream cooling holes relative to the vanes. The downstream holes may be inclined at a shallower angle to the end wall component surface than the upstream holes.

Either or both of the upstream and downstream rows of cooling holes may have a half-wave sinusoidal configuration. The half-wave sinusoidal portion extends in a downstream direction towards the mid-vane portion.

One or more of the cooling holes may have an elliptical or racetrack-shaped transverse cross-sections relative to the direction of flow through the holes. The long axis of the transverse cross-section at the exit of each cooling hole to the mainstream gas annulus is aligned with the direction of flow of the mainstream gas over the exit to within ±20°.

Advantageously, by aligning the long axis in this way, the cooling air jets can be made more resistant to being bent over by the mainstream gas. The jets can thus penetrate further into the mainstream gas, and the thermal benefit of the cooling air can be transferred to locations further downstream of the holes. In contrast, conventional circular cross-section ballistic cooling holes produce jets which are bent over more easily by the mainstream gas, such that more of the cooling benefit of the cooling air is expended at locations close to the holes.

A first portion of the cooling holes may have a first diameter. A second portion of cooling holes may have a second diameter which is different to the first diameter.

The end wall component may further comprise a plurality of film cooling holes located between adjacent vanes.

In another aspect, the invention provides a nozzle guide vane having an end wall component according to the first aspect. The cooling holes may have transverse cross-sectional areas of 2 $mm^2$ or greater, and preferably may have transverse cross-sectional areas of 4 $mm^2$ or 8 $mm^2$ or greater. Holes of such cross-sectional area can help to pass a relatively high rate of cooling air flow. The cooling holes may have transverse cross-sectional areas of 20 $mm^2$ or less.

The cooling holes may be drilled at a trajectory angle of 45° or more to the mainstream gas-washed surface of the end-wall component.

The cooling holes may provide substantially no film cooling.

The long axis of the transverse cross-section at the exit of each cooling hole to the mainstream gas annulus may be aligned with the direction of flow of the mainstream gas over the exit to within ±10° or ±5°.

The cooling holes may be arranged in one or more circumferentially extending rows. The circumferential spacing of the cooling holes in the or each row may vary. For example, the holes may be more densely packed in regions from where the cooling air can be transferred, via the jets, to downstream locations requiring extra cooling. Additionally, or alternatively, the axial position of the cooling holes in the or each row may vary. In this way, downstream locations requiring cooling can be more precisely targeted by the cooling air, Additionally, or alternatively, the trajectory angle of the cooling holes in the or each row may vary, e.g. in order to change the depth of coolant penetration in to the mainstream gas. The cooling holes may be drilled at trajectory angles of from 45° to 85°, and preferably from 45° to 65°, to the mainstream gas-washed surface of the end-wall component.

At the exit of each cooling hole, the ratio of the long axis of the transverse cross-section to the short axis of the transverse cross-section may be two or more. At the exit of each cooling hole, the ratio of the long axis of the transverse cross-section to the short axis of the transverse cross-section may be four or less.

Typically, the component can be a rear inner or rear outer discharge nozzle sealing ring which bridges a gap between an end-wall of the combustor and a platform of a nozzle guide vane of the high pressure turbine. However, another option is for the component to be an inner or outer platform of a nozzle guide vane of a high pressure turbine (e.g. with the rows of ballistic cooling holes located upstream of the leading edge of the aerofoil of the nozzle guide vane). In either case, the cooling air may usefully be transferred, via the jets, to a rear overhang portion of the platform, adjacent the vane aerofoil trailing edge. Whether the component is a discharge nozzle sealing ring or a nozzle guide vane platform, the engine typically has in mainstream gas flow series a high pressure compressor, a combustor and the high pressure turbine, and the dilution cooling air jetted into the mainstream gas through the ballistic cooling holes can be derived by diverting air compressed by the high pressure compressor away from the combustor and towards the end-wall component as dilution cooling air. The cooling holes of the or each end-wall may then be configured to pass a flow rate of the dilution cooling air corresponding to at least 2%, and preferably at least 3% or 7%, of the air compressed by the high pressure compressor.

Further optional features of the invention are set out below.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
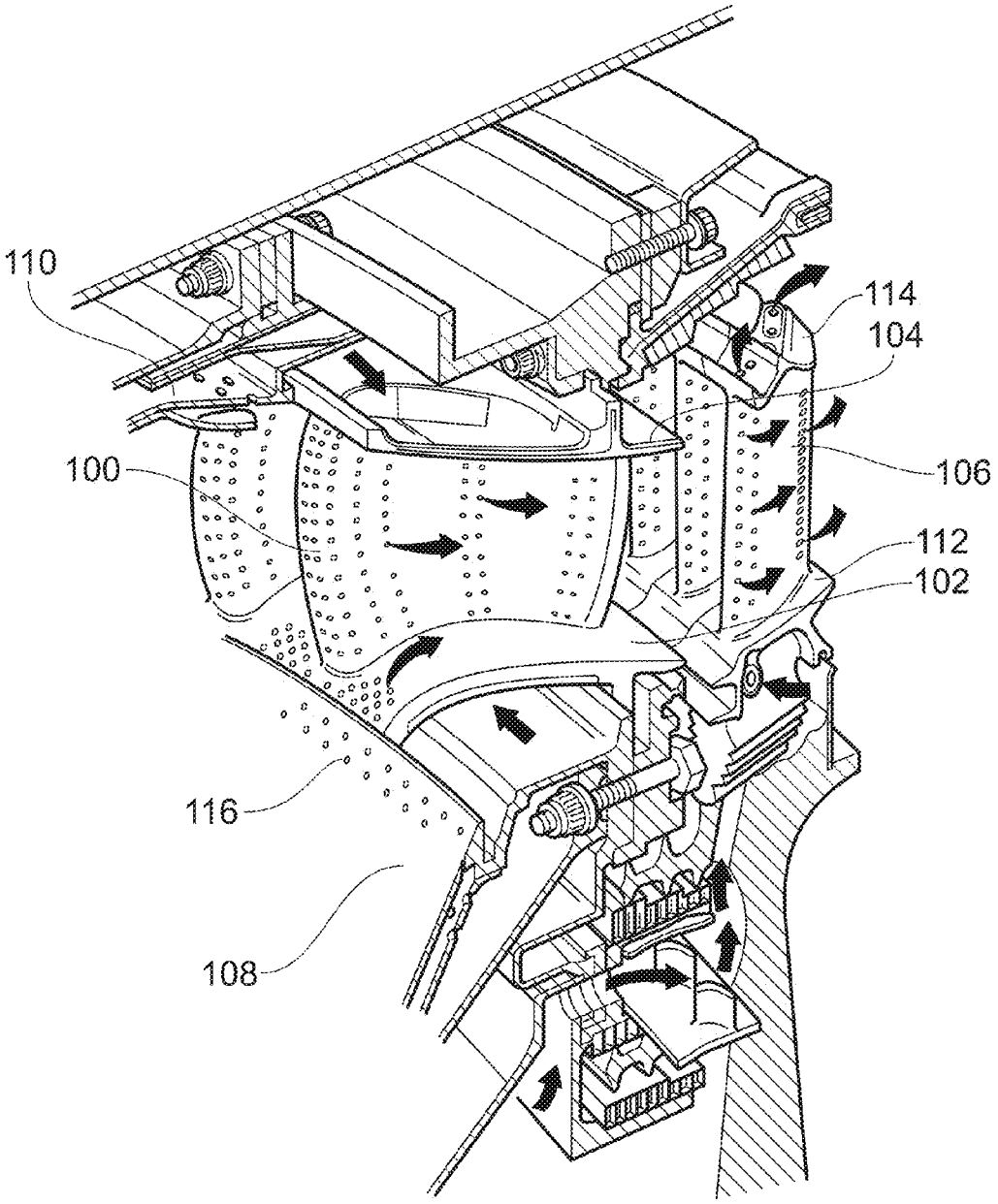
FIG. 1 shows an isometric view of a conventional HP stage cooled turbine.
Figure 2:
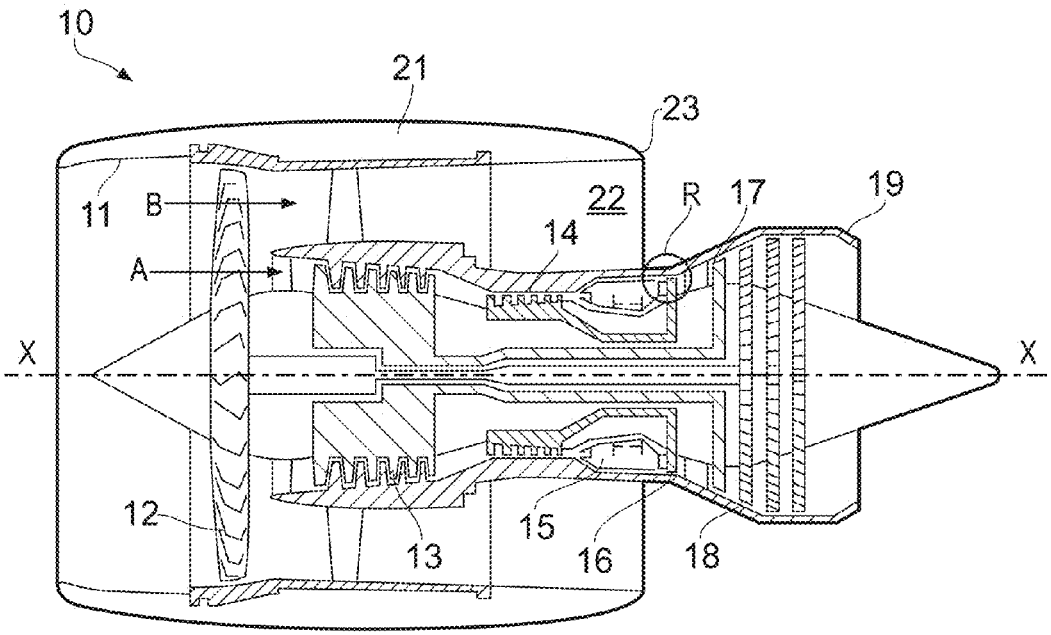
FIG. 2 shows a longitudinal cross-section through a ducted fan gas turbine engine.

With reference to FIG. 2, a ducted fan gas turbine engine incorporating the invention is generally indicated at 10 and has a principal and rotational axis X-X. The engine comprises, in axial flow series, an air intake 11, a propulsive fan 12, an intermediate pressure (IP) compressor 13, a high-pressure (HP) compressor 14, a combustor 15, a high-pressure (HP) turbine 16, and intermediate pressure (IP) turbine 17, a low-pressure (LP) turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the IP compressor 13 and a second air flow B which passes through the bypass duct 22 to provide propulsive thrust. The IP compressor 13 compresses the air flow A directed into it before delivering that air to the HP compressor 14 where further compression takes place.

The compressed air exhausted from the HP compressor 14 is directed into the combustor 15 where it is mixed with fuel and the mixture combusted. The resultant hot combustion products then expand through, and thereby drive the HP, IP and LP turbines 16, 17, 18 before being exhausted through the nozzle 19 to provide additional propulsive thrust. The HP, IP and LP turbines respectively drive the HP and IP compressors 14, 13 and the fan 12 by suitable interconnecting shafts.

Figure 3:
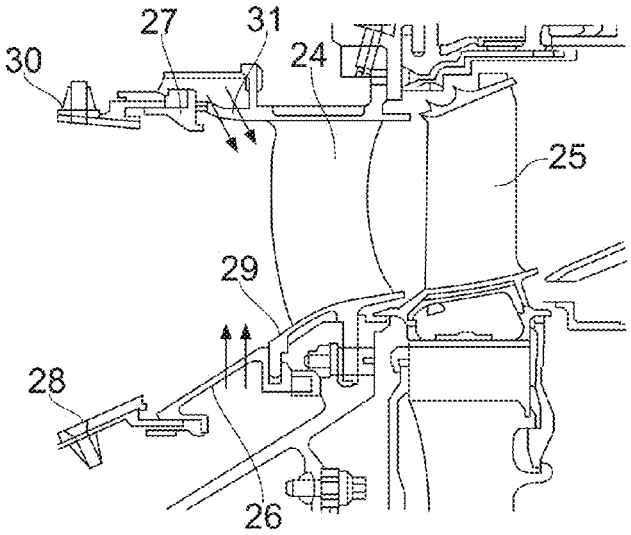
FIG. 3 shows in more detail the circled region labelled R in FIG. 2.

FIG. 3 shows in more detail the circled region labelled R in FIG. 2, between the combustor 15 and the NGVs 24 and turbine blades 25 of the HP turbine 16. A RIDN sealing ring 26 extends across the gap between an inner end-wall 28 of the combustor and NGV segment inner platforms 29, and a RODN sealing ring 27 extends across the gap between an outer end-wall 30 of the combustor and NGV segment outer platforms 31.

Figure 4:
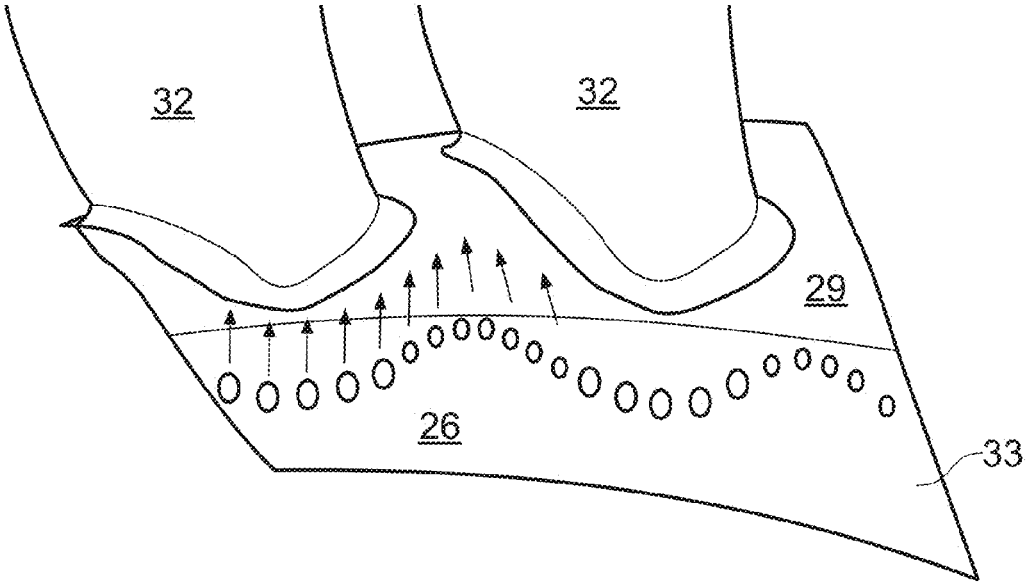
FIG. 4 shows an isometric view of a pair of aerofoils of the NGVs of FIG. 3 and a RIDN ring with a single row of RIDN Holes.

FIG. 4 shows an isometric view of a pair of aerofoils 32 of the NGVs 24. An inner platform 29 is located at the root of the NGVs. In front of the inner platform is the RIDN ring 26, which contains a circumferentially extending row of ballistic cooling holes 33. Similar rows of holes can be formed in the RODN ring 27. HP compressor cooling air which by-passes the combustor is jetted through the holes into the mainstream gas annulus. For example, the amount of cooling air which passes through the holes of the RIDN ring can be 2% or more of the air compressed by the HP compressor, and the amount of cooling air which passes through the corresponding holes of the RODN ring can be 5% or more of the air compressed by the HP compressor. To accommodate such a flow, the holes have transverse cross-sectional areas relative to the direction of flow through the holes which may be greater than 2 $mm^2$ (10 $mm^2$ is typical for the RIDN ring, and the corresponding holes in the RODN ring may also have transverse cross-sectional areas of around 10 $mm^2$). Although not shown in FIG. 4, there can be more than one row of holes, and between rows the holes can be circumferentially staggered. In this way, a more uniform airflow distribution can be achieved.

The cooling holes 33 shown in FIG. 4 have elliptical or racetrack-shaped transverse cross-sections but may have circular cross-sections. The ratio of the long axis of the transverse cross-section to the short axis of the transverse cross-section can be in the range from two to four. The long axis of the transverse cross-section at the exit of each cooling hole to the mainstream gas annulus is aligned to within ±20° with the direction of flow of the mainstream gas over the exit, and preferably is aligned to within ±10° or ±5°. By aligning the long axis in this way, the cooling air jets are less prone to being bent over by the high momentum mainstream gas. As a result, the cooling air can be transferred to locations requiring cooling which are further downstream of the holes, such as the rear overhang of the platform 29.

Figure 5:
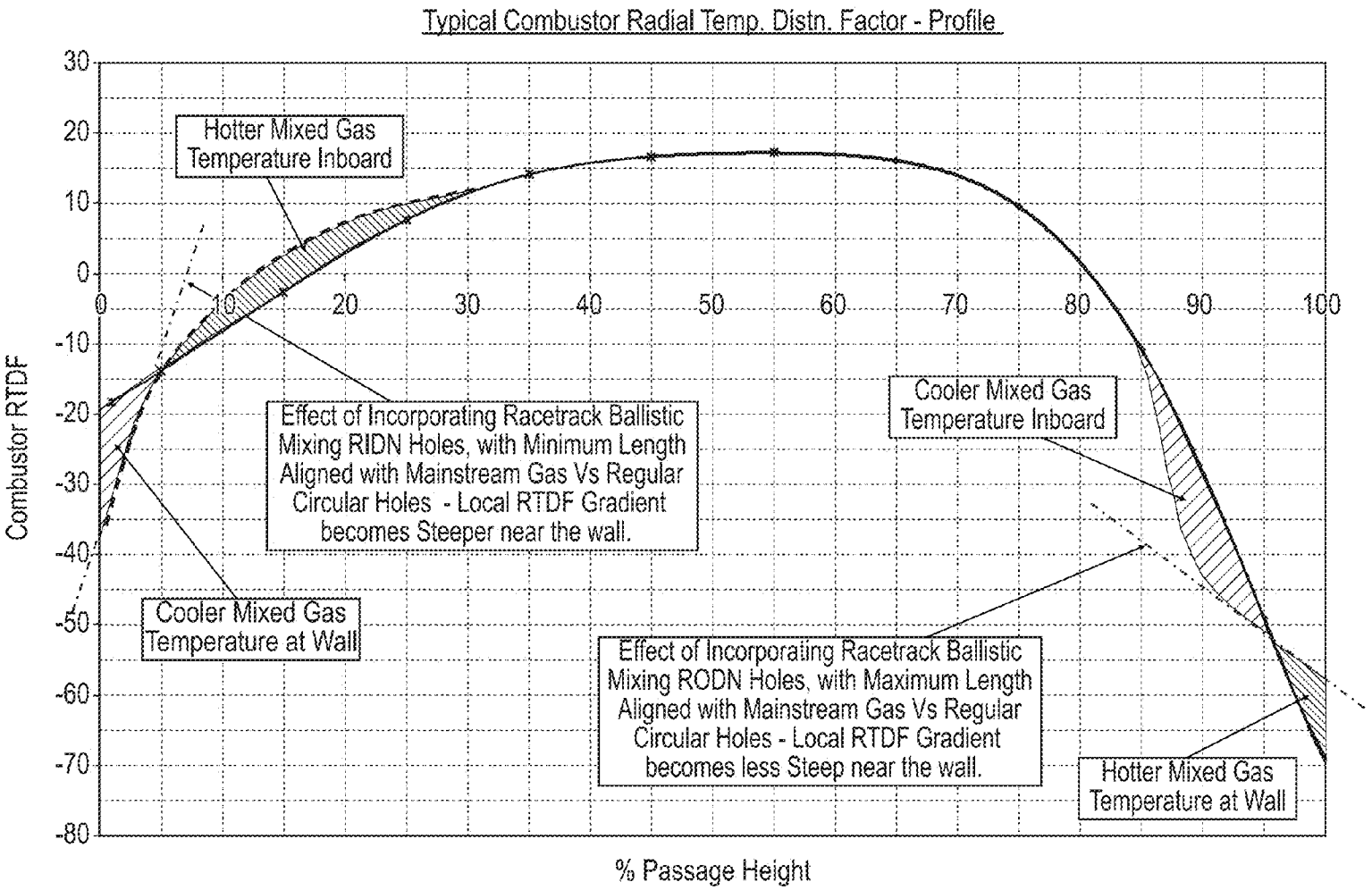
FIG. 5 shows a plot of the combustor radial temperature distribution factor (RTDF) against radial height across the annular mainstream gas passage for conventional arrangements of circular cross-section ballistic cooling holes in the inner and outer NGV platforms, and also shows effects of varying the conventional arrangements.

In FIG. 4, the cooling holes 33 are introduced into the RIDN sealing ring 26. However, another option is to introduce the holes into the forward region of the NGV platform (upstream of the leading edge of the aerofoil). FIG. 5 shows graphically the effect on the combustor Radial Temperature Distribution Factor (RTDF) of introducing such holes into the platform. The graph plots the RTDF against radial height across the annular mainstream gas passage for conventional arrangements of circular cross-section ballistic cooling holes in the inner and outer platforms. The graph then shows the change to the RTDF adjacent the outer platform when the circular holes are exchanged for holes having elliptical or racetrack-shaped transverse cross-sections in which the long axes of the transverse cross-sections at the exits of the cooling holes are aligned with the direction of flow of the mainstream gas and the total flow rate of cooling air is kept constant. The graph also shows the change to the RTDF adjacent the inner platform when the circular holes are exchanged for holes having elliptical or racetrack-shaped transverse cross-sections in which the short axes of the transverse cross-sections at the exits of the cooling holes are aligned with the direction of flow of the mainstream gas and again the total flow rate of cooling air is kept constant. Adjacent the outer platform, the RTDF increases over the region 95-100% passage height, and reduces over the region 85-95% passage height, relative to the original RTDF distribution with circular holes. This causes the gradient of the profile close to the wall to decrease, reducing the gas temperature in the vicinity of the NGV outer platform downstream edge, but increasing the gas temperature in the vicinity of the holes. In contrast, adjacent the inner platform, the RTDF reduces over the region 0-5% passage height, and increases over the region 5-30% passage height, relative to the original RTDF distribution with circular holes. This causes the gradient of the profile close to the wall to increase, reducing the gas temperature in the vicinity of the holes.

Although not shown in FIG. 4, the ballistic cooling holes 33 within a given row can be grouped to form regions of densely packed holes (holes pitched closely together), and regions where the holes are sparsely packed (holes pitched relatively far apart with respect to one another). This allows the cooling flow to be focused in specific locations where secondary flows can act on the coolant in a positive manner to direct it to desired locations. Computational fluid dynamics (CFD) analysis may be required in order to optimise the injection locations but typical hole pitch/diameter ratios range may from 2 to 4 within a given row. Hence, for a given hole diameter, the pitch of closely spaced holes will be approximately half that of the sparsely packed holes.

The ballistic cooling holes 33 within a given row can have a varying axial distance from the aerofoil leading edge. In the arrangement of FIG. 4, the holes are arranged so as to have a sinusoidal distribution. Having axial variance allows the cooling flow to benefit from the static pressure distribution on the platform end-wall 29, e.g. in order to send more coolant into the regions where the secondary flows direct the coolant into the path of hot gas migrating from the aerofoil pressure surface down onto the platform. By diluting this hot gas stream with relatively cool ballistic air, characteristic "hot spots" that occur at the rear of platform can be avoided and a need for additional localised cooling eliminated or reduced. It can also be advantageous to locate ballistic cooling holes immediately upstream of the aerofoil leading edge in order to locally dilute the hot gas that migrates onto the NGV platform due to the "horseshoe" vortex (sometimes referred to as the "bow wave") which forms at the leading edge. At this location the local static pressure is close to the local total pressure, and consequently the coolant mass flow per hole is low.

The ballistic cooling holes 33 within a given row can have a varying trajectory angle in order to change the depth of coolant penetration into the mainstream gas. For example, the cooling holes may be drilled at trajectory angles of from 45° to 85° to the gas-washed surface of the platform 29.

Figure 6:
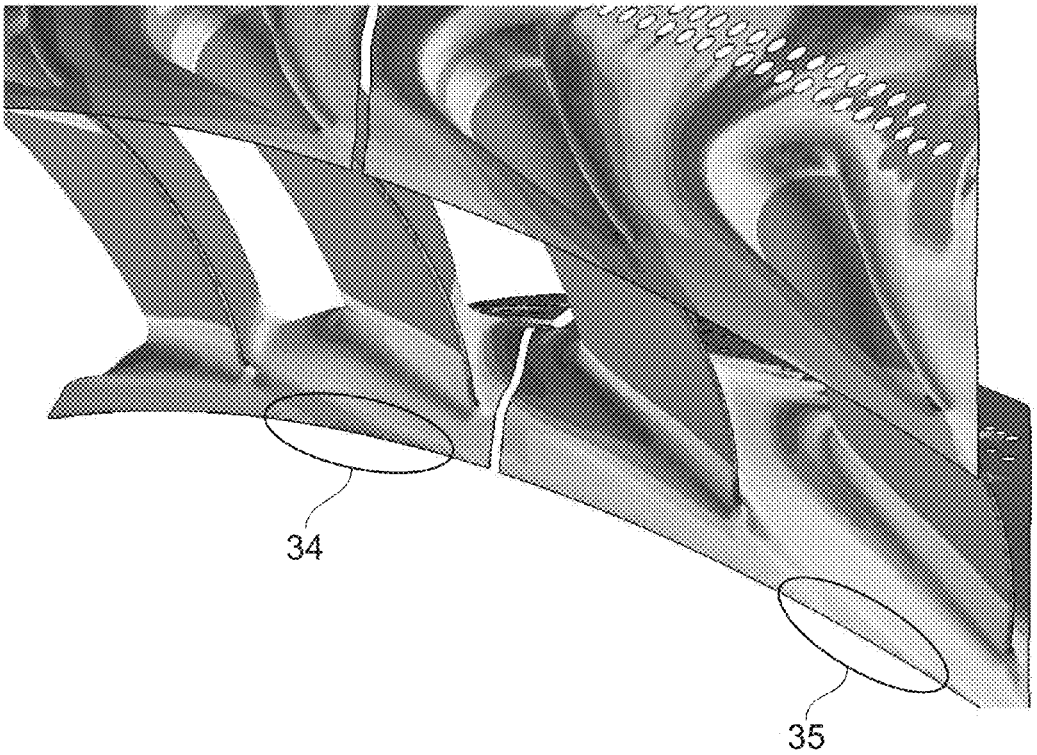
FIG. 6 shows a comparison of computational fluid dynamics NGV platform metal temperature distributions with (at left) circular cross-section ballistic cooling holes in RIDN and RODN sealing rings, and (at right) elliptical or racetrack-shaped ballistic cooling holes in the NGV inner and outer platforms.

FIG. 6 shows a comparison of CFD NGV platform metal temperature distributions with (at left) circular cross-section ballistic cooling holes in the RIDN and RODN sealing rings, and (at right) elliptical or racetrack-shaped ballistic cooling holes in the NGV inner and outer platforms, the long axes of the elliptical or racetrack-shaped cross-sections being aligned with the direction of flow of the mainstream gas. In the left hand conventional arrangement excessive local metal temperatures are seen in a region 34 of the inner platform rear overhang. This can lead to spallation of thermal barrier coatings (TBCs) which are typically applied to NGV platforms. In contrast, in the right hand arrangement with elliptical or racetrack-shaped cooling holes, metal temperatures at the corresponding region 35 of the inner platform rear overhang are significantly reduced. This can help to increase the life of the rear overhang through reduced oxidation of TBC bond coats, reduced oxidation of platform base alloy, and reduced thermal fatigue cracking.

In general, the improved cooling of the inner platform 29, and the improved cooling of the outer platform 31 when elliptical or racetrack-shaped ballistic cooling holes are adopted can help to reduce coolant flow to plenum chambers formed within the platforms, with attendant improvements in turbine efficiency and specific fuel consumption. Indeed it can be possible to avoid the need for such coolant flows entirely, removing the cost of providing such plenum chambers in the platform castings.

It will be appreciated that the location of the ballistic cooling holes will be dependent on many variables associated with the specific architecture of the engine in which they are employed, but generally the preferred location is to provide a periodic axial distribution of cooling holes around the circumference of the annulus, the periodicity of which matches the periodic distribution of the vanes. The extent of the axial variation is preferably a sinusoidal distribution which fits a first order sinusoid, and this is generally the arrangement discussed below. However, it will be appreciated that where sinusoidal is referred to, other non-sinusoidal axially varying distributions may be used.

FIGS. 7 to 12 show variants of the invention in which preferable configurations of ballistic cooling holes are provided upstream of the vanes.

FIGS. 7 to 12 each show two different configurations of ballistic cooling hole arrangements in adjacent NGV segments. The segments are shown adjacent one another to better highlight the differences in the cooling hole arrangements and it will be appreciated that adjacent NGVs in a working engine would have similar configurations of cooling holes to each other to provide a periodic circumferential distribution of cooling holes in accordance with the cooling requirements of the NGV platforms.

Figure 7:
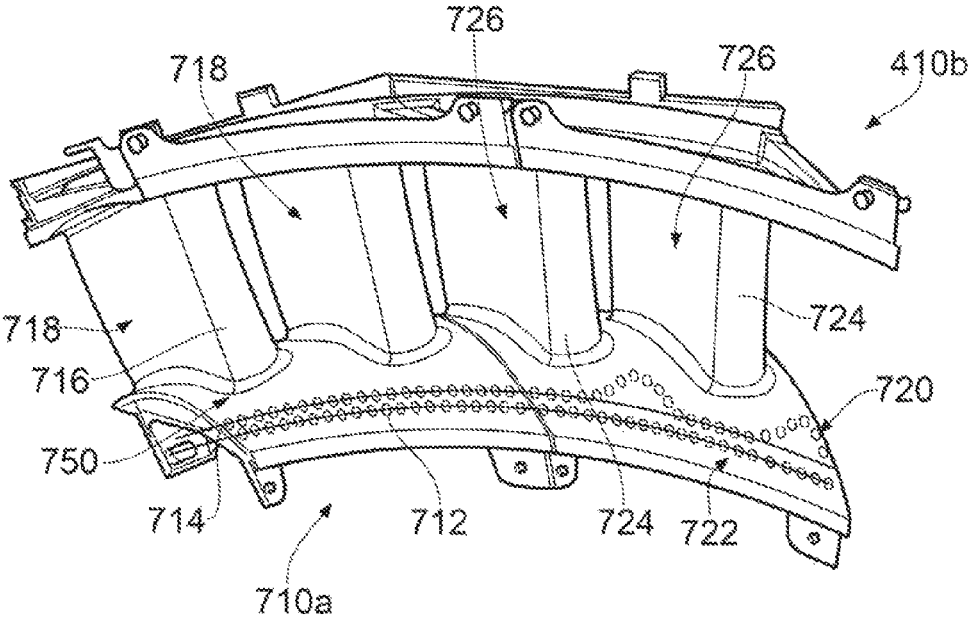
FIG. 7 shows an axial end view of two different NGV segments. The left hand NGV as viewed shows a known arrangement of ballistic cooling holes. The right hand NGV shows an arrangement in which one of the rows of ballistic cooling holes is axially varying.

The arrangement shown in the left hand side NGV 710*a* of FIG. 7 is a known arrangement in which there are two axially separated rows of cooling holes 712, 714 upstream of the leading edge 716 of the vanes 718. The holes are circumferentially staggered such that each hole lies on a different axial line of the main gas path flow as indicated by the small solid arrow.

The NGV 710*b* shown in right hand side of FIG. 7 shows an alternative arrangement in which there are two axially separated rows of cooling holes 720, 722 of which one of the rows 720 has a varying axial separation from the leading edge 724 of the vanes 726. Thus, the upstream row of holes 722 is conventional in the sense that the cooling holes are placed at a constant axial distance from the leading edge 724 of the vanes 726 around the annulus. The downstream row of holes 720 is placed along the approximate line of a static pressure contour of the annulus and has a half-wave sinusoidal structure. Thus, there is an axial variance in the mid-vane portion of holes 720 which follows the static pressure contour downstream so as to extend towards, and in some embodiments between, adjacent vanes. The downstream row 720 also includes portions local to the stagnation zone 750. These portions have constant axial spacing relative to the leading edge of the vanes. It will be appreciated that the static pressure contour local to the leading edges of the vanes will not be a straight contour. In this instance, reference to the cooling holes following the static pressure contour is with regard to the axially varying portions only.

Figure 8:
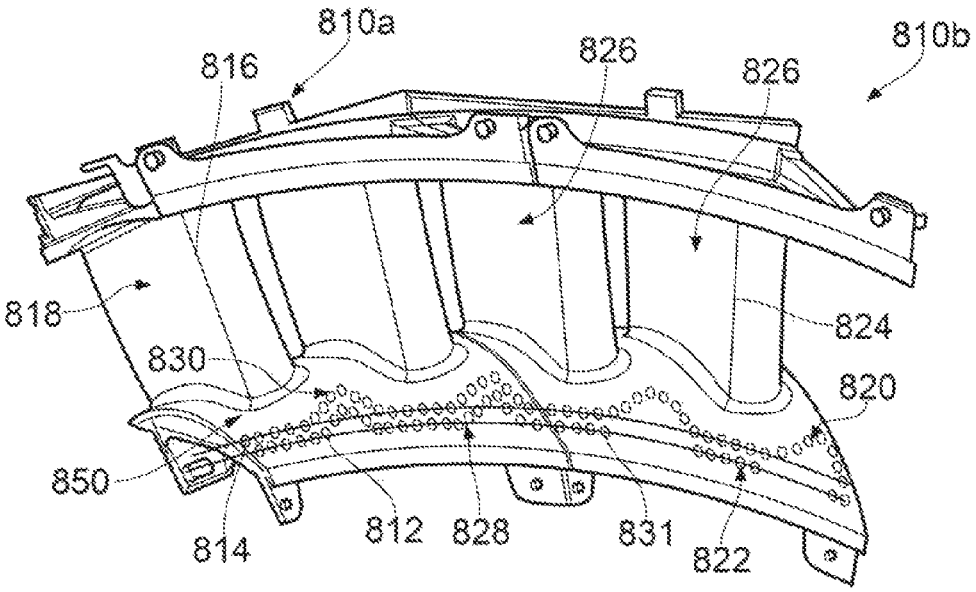
FIG. 8 shows an axial end view of two NGV segments, each having alternative configurations of axially varying cooling holes.

In the NGV 810*a* shown in the left hand arrangement of FIG. 8, the ballistic cooling holes in the upstream row 812 and downstream row 814 include corresponding sinusoidal half-wave configurations such that there are two rows which have substantially constant axial separation relative to one another. Each of the rows 812, 814 includes a straight portion 828 having cooling holes evenly distributed along a circumferential line which is at a fixed axial distance from the leading edge line of the vanes. The circumferential extent of the straight portions 828 and sinusoidal portions 830 is approximately equal. The sinusoidal portions extend from the respective circumferential line downstream towards the mid-portion of the vanes 818. The straight portions 828 lie at a constant axial distance adjacent the stagnation region 850 local to the leading edge 816 of the vanes 818.

The NGV 810*b* shown on the right hand side of FIG. 8 is similar to that on the left hand side of FIG. 8, but the upstream row 822 is intermittent so as to only have a distribution of cooling holes local to the leading edge 824 of the vanes 826 and adjacent the stagnation stagnation region 850. The cooling holes in the upstream row 822 have a straight portion 831 which lies along a circumferential line and have a constant axial separation from the leading edge line of the vanes 826. The downstream rows 820 are similar to the distribution described in relation to the NGV 810*a* described above.

Figure 9:
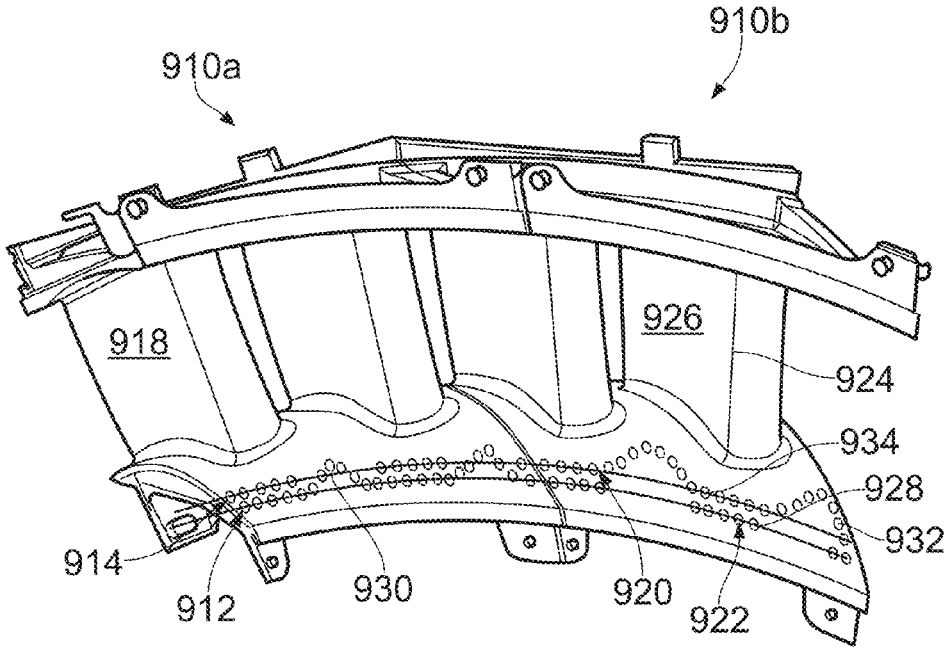
FIG. 9 shows an axial end view of two further NGV segments, each having alternative configurations of axially varying cooling holes.

FIG. 9 shows two further arrangements of cooling holes. The NGV 910*a* in the left hand side is similar to the arrangement described in the NGV 810*b* of FIG. 8 in that there is a continuous row 912 of cooling holes having a half wave sinusoidal structure and an intermittent row 914 made up of segments of straight portions of holes interspersed with circumferential sections with no holes. However, in the embodiment of FIG. 9, it is the downstream row 914 which has the intermittent distribution and the upstream row 912 which has the half sinusoid configuration 930. The upstream and downstream rows are axially spaced relative to one another such that the amplitude of the half-sinusoid extends in a downstream direction between the straight portions of the axially downstream row.

The NGV 910*b* shown in the right hand side of FIG. 9 includes an intermittent distribution in the upstream row 922 and a half sinusoid in the downstream row 920 which is similar to the arrangement shown in the right hand side of FIG. 8. Thus, there is an upstream row 922 with a circumferentially intermittent distribution of cooling holes made up from blocks of cooling holes 928 arranged along a circumferential line having a constant axial separation from the leading edge 924 of the vanes 926. The downstream row 920 of cooling holes includes a straight portion 934 having cooling holes evenly distributed along a circumferential line which is at a fixed axial distance from the leading edge line of the vanes 926 and axially varying portions 932 in the form of half wave sinusoids. The circumferential extent of the straight portions 934 and sinusoidal portions 932 is approximately equal but this may be varied according to the cooling requirements of a particular architecture. The sinusoidal portions 932 extend from the respective circumferential line downstream towards the mid-portion of the vanes 926. The difference between NGV 910*b* and 810*b* is in the angles of the holes in half sinusoidal portions of the downstream row 920.

Figure 10A:
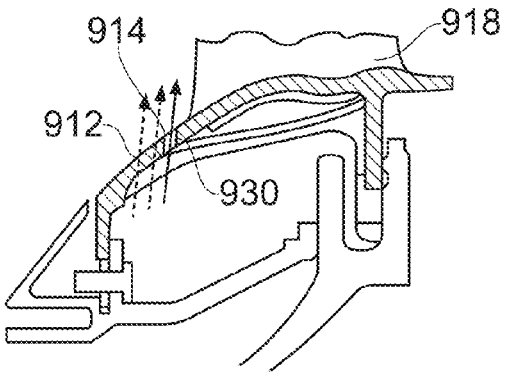
FIGS. 10*a* and 10*b* show sectional views of the NGVs shown in the left and right hand sides of FIG. 9 respectively. The sectional views show the different angles of inclination of the cooling holes.
Figure 10B:
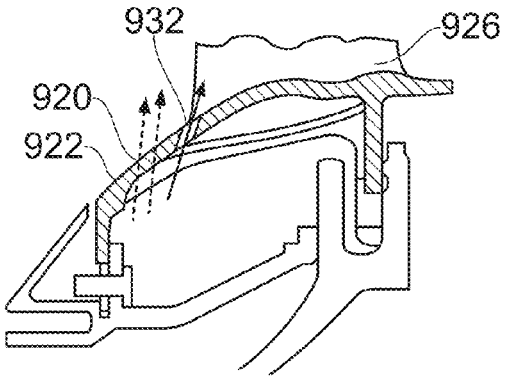

The angles of the holes shown in NGV 910*a* and NGV 910*b* are shown in the sections of FIGS. 10*a* and 10*b* respectively. Thus, in FIG. 10*a*, the axially constant and axially varying portions of the upstream 912 and downstream 914 cooling holes are the same and generally inclined at 55 degrees to the gas washed surface so as to provide a penetrating flow of cooling air in a slightly downstream direction. The angle of the axially varying holes 932 relative to the surface of the RIDN in FIG. 10*b* is altered in comparison to the remaining holes in the first and second rows such that the trajectory of the emerging flow is inclined more towards the platform surface so as to provide less penetration. The size of holes in FIG. 10*a* are typically in the range of 2 mm+/−0.2 mm and the angle relative to the principal axis of the engine will typically be 55 degrees but may be between 45-65 degrees. In FIG. 10*b*, the size may be reduced to between 1.25 mm to 1.75 mm and the angle reduced to between 35 and 45 degrees. Thus, in the arrangement of 910*b* and FIG. 10*b* there is a first portion of holes having a first diameter, and a second portion of holes having a second diameter which is different to the first diameter.

Figure 11:
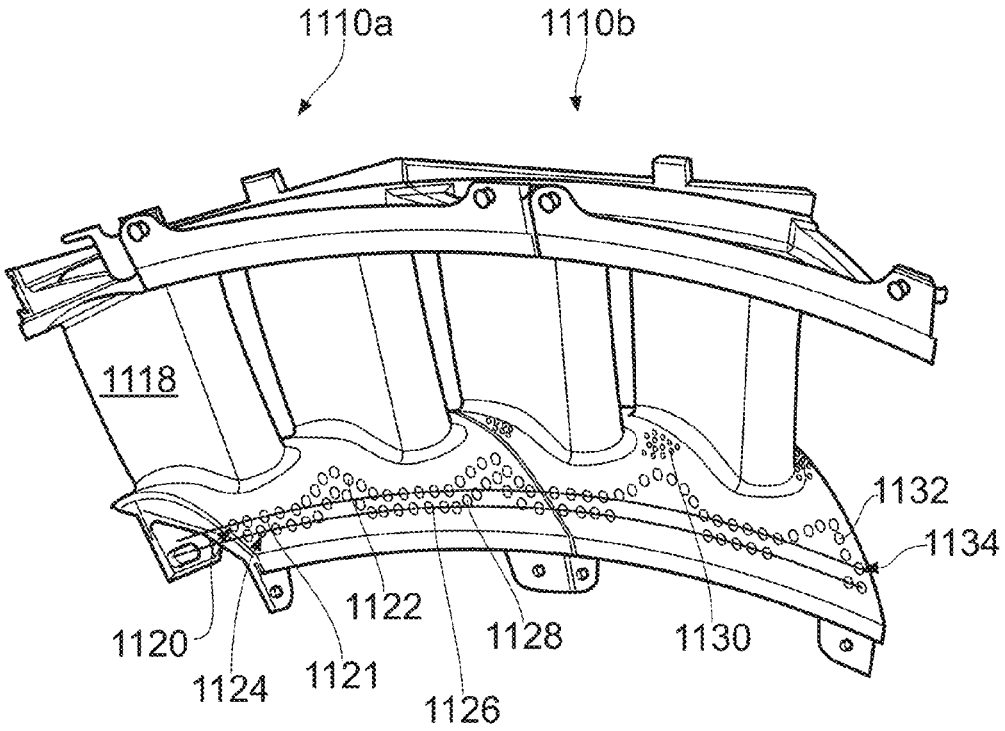
FIG. 11 shows an axial end view of yet two further NGV segments, each having alternative configurations of axially varying cooling holes.

FIG. 11 shows yet two further arrangements of NGVs, 1110*a* and 1110*b*. The NGV 1110*a* in the left hand side of FIG. 11 shows an adaptation of the embodiment shown in the right hand side of FIG. 9. Hence, there is shown a downstream row 1120 of cooling holes which includes a straight portion 1121 having cooling holes evenly distributed along a circumferential line which is at a fixed axial distance from the leading edge line of the vanes 1118, and axially varying portions in the form of half sinusoidal portions 1122 at circumferentially between adjacent vanes 1118. The upstream row 1124 is similarly arranged with axially constant portions 1126 adjacent the leading edge, and axially varying portions 1128 circumferentially upstream of the mid vane region. The circumferential extent of the straight portions 1126 and sinusoidal portions is approximately equal but this may not be the case in some arrangements. The axially varying portions in both the upstream and downstream rows extend from the respective circumferential line downstream towards the mid-portion of the vanes 1118.

Figure 12A:
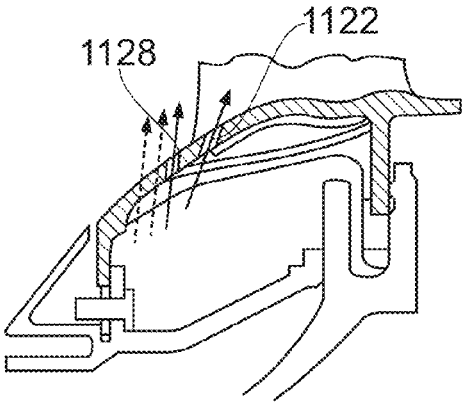
FIGS. 12*a* and 12*b* show sectional views of the NGVs shown in the left and right hand sides of FIG. 11 respectively. The sectional views show the different angles of inclination of the cooling holes.

The difference between the upstream 1124 and downstream 1120 rows is in the respective angles of the holes in half sinusoidal portions 1122, 1128. As shown in FIG. 12*a*, the downstream holes are inclined at a less steep angle relative to the surface of the platform and will thus not penetrate the main gas flow path to the same extent as the corresponding upstream holes. In this way, a greater distribution of airflow can be achieved which helps alleviate temperature related effects in the mid-vane and trailing edge portions of the platform.

Figure 12B:
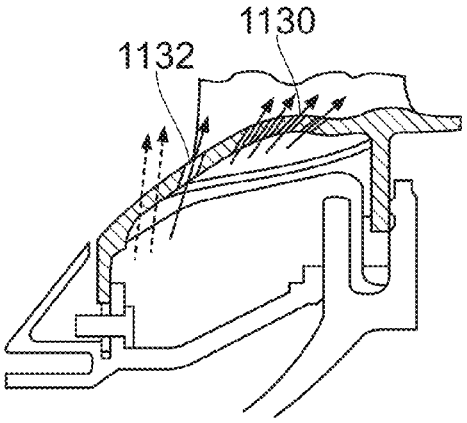

The NGV 1110*b* shown in the right hand side of FIG. 11 and in section in FIG. 12*b* is similar to the arrangement shown in the right hand side of FIG. 8. However, the arrangement includes inter-vane platform film cooling holes 1130 and the size and angle of the cooling holes 1132 in the axially varying portion of the downstream holes 1134 are smaller than the other ballistic cooling holes and at a shallower angle relative to the RIDN surface. In one example, the smaller ballistic cooling holes 1132 have a diameter which is 1.5 mm+/−0.2 mm with an inclination angle of 50 degrees, with the remaining ballistic holes having a size in the region of approximately 2 mm+/−0.2 mm and the angle relative to the principal axis of the engine typically around 55 degrees but may be between 45-65 degrees. As will be appreciated, the inter-vane film cooling holes 1130 may have diameters anywhere between 0.25 mm and 1.0 mm and angles of 20-30 degrees relative to the platform surface as is typical for film cooling holes.

It will be appreciated that the various embodiments described in FIGS. 7 to 12 are each advantageous in their own right and provide benefits for the engine performance. Generally, the ballistic cooling holes are located in the upstream region of the NGV aerofoil leading edge with the aim of reducing or entirely eliminating the so-called horse shoe vortices which emerge from base of the leading edge vane. The holes located between the aerofoil leading edge zones are aimed at reducing the component gas temperature towards the rear of the NGV platform where the high heat transfer coefficients combine with high gas temperature and typically result in localised overheating.

Changing the size, inclination, shape, and distribution of the cooling holes, allows the requirements of specific vane arrangement to be accounted for. In general, smaller diameter and less steeply inclined holes can be used to reach mid-platform locations, while larger diameter or race track shaped holes with or without a steeper angle of inclination can be used to provide a greater degree of gas flow penetration so as to reach the more downstream portions of the platforms and overhangs.

Including a portion of film cooling between the vanes in a mid-platform portion can be used advantageously where the ballistic cooling air flow cannot be targeted, or where the balletic cooling air is better directed to another portion of the platform.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An end-wall component of a mainstream gas annulus of a gas turbine engine, the gas turbine engine comprising an annular arrangement of vanes and the mainstream gas annulus including a main flow direction from upstream of the annular arrangement of vanes to downstream the annular arrangement of vanes, the end-wall component comprising a cooling arrangement including ballistic cooling holes through which, in use, a dilution cooling air is jetted into the mainstream gas annulus upstream of the annular arrangement of vanes to reduce the mainstream gas temperature adjacent the end-wall, wherein the ballistic cooling holes are arranged in one or more circumferentially extending rows, wherein an axial position of the ballistic cooling holes in the or each row varies so as to have axial variation, and wherein the axial variation is sinusoidal with circumferential periodicity which matches the periodic distribution of the vanes with circumferential mid-vane peaks which extend downstream so as to provide a sinusoidal coolie flow distribution from the ballistic cooling holes.

2. The end-wall component as claimed in claim 1, wherein the end wall component is a radially inner platform of a nozzle guide vane and the axial variation includes upstream and downstream peaks relative to the flow direction, wherein the downstream peaks of an inner platform lie along a gas flow line of a stagnation region local to a leading edge of the vanes.

3. The end-wall component as claimed in claim 1, wherein the ballistic cooling holes are arranged in two axially spaced rows so as to provide an upstream row and a downstream row, wherein at least a portion of one of the rows has a portion adjacent a stagnation region of the vane.

4. The end-wall component as claimed in claim 3, wherein either or both of the upstream and downstream rows have axial variation in relation to the flow direction.

5. The end-wall component as claimed in claim 3, wherein either or both of the upstream and downstream rows are intermittent so as to have circumferentially extending portions of two or more ballistic cooling holes interspersed with circumferential portions having no ballistic cooling holes.

6. The end-wall component as claimed in claim 5, wherein the portion with no ballistic cooling holes is aligned with a circumferential mid-vane portion.

7. The end-wall component as claimed in claim 1, wherein the ballistic cooling holes have a diameter of between 1.3 mm and 2.8 mm.

8. The end-wall component as claimed in claim 1, wherein the ballistic cooling holes have a trajectory which is inclined to the main rotational axis of the engine at an angle of between 45 and 65 degrees.

9. The end-wall component as claimed in claim 3, wherein the downstream holes are inclined at a shallower angle to the end wall component surface than the upstream holes.

10. The end-wall component as claimed in claim 3, wherein either or both of the upstream and downstream rows of ballistic cooling holes have a half-wave sinusoidal configuration, wherein the half-wave sinusoidal portion extends in a downstream direction towards a circumferential mid-vane portion.

11. The end-wall component as claimed in claim 1, wherein one or more of the ballistic cooling holes has elliptical or racetrack-shaped transverse cross-sections relative to the direction of flow through the holes, and the long axis of the transverse cross-section at the exit of each cooling hole to the mainstream gas annulus is aligned with the direction of flow of the mainstream gas over the exit to within ±20°.

12. The end-wall component as claimed in claim 1, wherein a first portion of the ballistic cooling holes have a first diameter, and a second portion of ballistic cooling holes have a second diameter which is different to the first diameter.

13. The end-wall component as claimed in claim 1, further comprising a plurality of film cooling holes located between adjacent vanes.

14. A nozzle guide vane comprising the end wall component according to claim 1.

* * * * *